US006181770B1

(12) United States Patent
Ciravolo et al.

(10) Patent No.: US 6,181,770 B1
(45) Date of Patent: Jan. 30, 2001

(54) X-RAY SOURCE INTERLOCK APPARATUS

(75) Inventors: Mark Rocco Ciravolo, Watertown; Francis M. Feda, Maynard, both of MA (US); Dave Violette, N. Grosvenordale, CT (US)

(73) Assignee: Photoelectron Corporation, Lexington, MA (US)

( * ) Notice: Under 35 U.S.C. 154(b), the term of this patent shall be extended for 0 days.

(21) Appl. No.: 09/210,045

(22) Filed: Dec. 11, 1998

(51) Int. Cl.[7] ..... H05G 1/54
(52) U.S. Cl. ..... 378/117; 378/65; 378/193
(58) Field of Search ..... 378/64, 65, 68, 378/114, 115, 117, 173, 195, 204, 205, 207; 606/130

(56) References Cited

U.S. PATENT DOCUMENTS 5,046,078 * 9/1991 Hernandez et al. ..... 378/119
5,452,720 * 9/1995 Smith et al. ..... 378/65
5,797,924 * 8/1998 Schulte et al. ..... 606/130

* cited by examiner

*Primary Examiner*—David P. Porta
(74) *Attorney, Agent, or Firm*—McDermott, Will & Emery

(57) ABSTRACT

An X-ray source interlock kit includes a probe-based portion integral with an X-ray source in communication with a peripheral-based portion, the interlock kit serving as an interface between an X-ray treatment system and a given class of peripheral devices. Peripheral devices are classified based on their shielding characteristics and whether or not radiation is permitted with the device, and include, for example, a stereotactic frame, a probe adjuster, and a photodiode array. The probe-based portion includes a probe side bushing having two optical source-detector pairs housed therein and interlock electronics, which accomplish signal processing as required. The peripheral-based portion is the form of a peripheral side bushing which is coded with the shielding and radiation information for a given class of peripheral devices. The peripheral side bushing of the interlock kit is mounted to a peripheral device of the appropriate class and the X-ray source incorporating the probe side bushing and the interlock electronics is then positioned against the peripheral side bushing to form the assembled interlock kit. When assembled, the probe side bushing and peripheral side bushing remain substantially in contact. Based on the coding of the peripheral side bushing, an optical path is established for one, both, or none of the optical source detector pairs. The X-ray source then radiates or is prevented from radiating, depending on the number of established optical paths, and satisfaction of other necessary system conditions.

23 Claims, 11 Drawing Sheets

X-RAY SOURCE INTERLOCK APPARATUS

CROSS-REFERENCE TO RELATED APPLICATIONS

Not Applicable.

STATEMENT REGARDING FEDERALLY SPONSORED RESEARCH

Not Applicable.

REFERENCE TO MICROFICHE APPENDIX

Not Applicable.

BACKGROUND OF THE INVENTION

This invention relates to a miniaturized, programmable X-ray treatment system having an X-ray source comprised of an electron beam source and an X-ray emitting probe for use in delivering substantially constant or intermittent levels of X-rays to a specified region and, more particularly, to an X-ray source interlock which serves as an interface between the X-ray source and one of a variety of peripheral devices.

In the field of medicine, radiation is used for diagnostic, therapeutic and palliative treatment of patients. The conventional medical radiation sources used for these treatments include large fixed position machines as well as small, transportable radiation generating probes. The current state of the art X-ray treatment systems utilize computers to generate complex treatment plans for treating complex geometric volumes. In most instances, these X-ray treatment systems are controlled using a control console, which provides the operator with an array of pertinent devices by which to operate, test, and calibrate the system, for example.

Typically, these systems apply doses of radiation in order to inhibit the growth of new tissue because it is known that radiation affects dividing cells more than the mature cells found in non-growing tissue. Thus, the regrowth of cancerous tissue in the site of an excised tumor can be treated with radiation to prevent the recurrence of cancer. Alternatively, radiation can be applied to other areas of the body to inhibit tissue growth, for example the growth of new blood vessels inside the eye that can cause macular degeneration.

One type of X-ray treatment system used for such applications is disclosed in U.S. Pat. No. 5,153,900 ('900 patent) issued to Nomikos et al., owned by the assignee of the present application, which is hereby incorporated by reference. The system disclosed in the '900 patent uses a point source of radiation proximate to or within the volume to be radiated. This type of treatment is referred to as brachytherapy. One advantage of brachytherapy is that the radiation is applied primarily to treat a predefined tissue volume, without significantly affecting the tissue in adjacent volumes.

An X-ray source of a typical X-ray treatment system is shown in FIG. 1. The X-ray source 10 includes an e-beam source 12 and a miniaturized insertable probe assembly 14 capable of producing low power radiation in predefined dose geometries or profiles disposed about a predetermined location. The probe assembly 14 includes a shoulder 16 which provides a rigid surface by which the X-ray source 10 may be secured to another element, such as a stereotactic frame used in the treatment of brain tumors. The probe assembly 14 also includes an X-ray emitting tube 18, or "probe", rigidly secured to shoulder 16. A typical probe of this type is about 10–16 cm in length and has an inner diameter of about 2 mm and an outer diameter of about 3 mm.

Typical radiation therapy treatment involves positioning the insertable probe 18 into the tumor or the site where the tumor or a portion of the tumor was removed to treat the tissue adjacent to the site with a "local boost" of radiation. In order to facilitate controlled treatment of the site, it is desirable to support the tissue portions to be treated at a predefined distance from the radiation source. Alternatively, where the treatment involves the treatment of surface tissue or the surface of an organ, it is desirable to control the shape of the surface as well as the shape of the radiation field applied to the surface.

In addition to the need to secure the X-ray treatment system or source to a peripheral device for patient treatments, e.g., a stereotactic frame 20 shown in FIG. 2, there is also a need to combine the X-ray source with other peripheral devices. For example, other peripheral devices may include a variety of apparatus for evaluating the system's performance and calibrating the probe. With each peripheral device, it is paramount for safety reasons that is the operator know whether the device shields the X-ray source and whether it is desirable for the probe to radiate, given the shielding of the peripheral device. Generally, peripheral devices may be divided into three classes. The first class includes devices which are unshielded and no radiation is permitted, for example, devices which measure and/or adjust dimensional features of a probe. The second class includes devices which are fully shielded and radiation is permitted, for example, "water tanks" used in simulating operational environments to accomplish testing of the radiation characteristics and calibrating of a probe. Finally, the third class includes devices which are unshielded and radiation is permitted, for example a stereotactic frame which supports the probe during patient treatment. A problem with typical X-ray sources and classes of peripheral devices is that the probe of the X-ray source may be mistakenly or accidently allowed to radiate with a given peripheral device, causing a radiation hazard to those present.

It is an object of the present invention to provide an X-ray source interlock kit which includes an X-ray source and an interlock assembly, wherein the X-ray source and interlock assembly communicate to control the output radiation of the X-ray source probe for a given class of peripheral device.

It is a further object of the present invention to provide an X-ray interlock as a communicative interface between an X-ray source and a given class of peripheral device, wherein a portion of the interlock is coded with the certain peripheral device characteristics to ensure appropriate output of radiation by the X-ray source probe.

SUMMARY OF THE INVENTION

The above and other objects of the present invention are achieved by an X-ray source interlock kit. The interlock kit includes a component affixed to an X-ray source in communication with a component affixed to a peripheral device. The interlock kit serves as an interface between the X-ray source of an X-ray treatment system and a given class of peripheral devices, wherein the X-ray source is comprised of an electron beam source, a probe shoulder and a probe. Peripheral devices are classified based on their shielding characteristics and whether or not radiation is permitted with the device, and include, for example, a stereotactic frame, a probe adjuster, and an X-ray sensitive photodiode array.

In a preferred form, affixed to the X-ray source is a probe-based portion of an interlock assembly which includes two each of an optical source (e.g., a light emitting diode (LED)) and an associated optical detector, forming two source and detector pairs. The optical sources are selectively toggled on and off by a signal generator within the X-ray source, or within a control console operatively connected to the X-ray source. A peripheral-based portion of the interlock assembly provides an optical signal path between either one, both or none of the optical sources and their associated detectors, depending on the coding of the peripheral-based portion of the interlock assembly. The probe-based portion and the peripheral-based portion are adapted for mated engagement, to form an interlock between the X-ray source and peripheral device. When engaged, if an optical signal path is provided, the peripheral-based portion of the interlock assembly reflects, in one embodiment, the optical signal received from the probe-based portion to the associated detector of the source-detector pair. Upon detection of an incident optical signal, the detector transmits a signal indicative thereof to a radiation controller within the X-ray source, or X-ray source control console. The radiation controller compares the signal from the detector with the signal produced by the signal generator. If there is a signal match or other predetermined correlation, the presence of an optical path is established by the interlock assembly. Wherein, based on the pattern of such established optical paths, conditions necessary for the radiation controller to enable or disable the electron beam source are satisfied.

The interlock assembly is in the form of a bushing assembly which includes a probe side bushing (i.e., probe-based portion of the interlock assembly) integral with the X-ray source and a peripheral side bushing (i.e., peripheral-based portion of the interlock assembly) affixed to the peripheral device, wherein the bushings are adapted for mated engagement. The probe side bushing is adapted to permit decoding of a number of classes of peripheral devices which may be coupled to the probe. The peripheral side bushing is coded for the specific class of device for its associated peripheral device, based on, for example, the shielding characteristics of the device and the desirability to radiate with the peripheral device. In the preferred form, coding takes the form of reflective grooves in the peripheral side bushing, which establish an optical path between the optical source(s) and detector(s) of the probe side bushing. Additionally, an opening in the center of the peripheral side bushing allows the probe to pass through that bushing and into its desired location.

In use, the probe side bushing is nested to, or engaged with, the peripheral side bushing of a peripheral device (of a given class), so that the optical source-detector pairs of the probe side bushing are aligned with the appropriate optical paths, e.g., reflectors, of the coded peripheral side bushing. The interlock assembly preferably includes a device which maintains placement of the probe side bushing against the peripheral side bushing and also maintains the alignment of the optical source-detector pairs with their respective optical paths. Based on the coding of the peripheral side bushing, signals transmitted by the optical sources of the probe side bushing are coupled by the peripheral side bushing to the detectors in the probe side bushing and, consequently, the radiation controller of the X-ray source permits or prohibits radiation, as is appropriate.

While the present invention is described with respect to a preferred embodiment, a variety of modifications may be made thereto to form other embodiments, in accordance with the present invention. For example, the reflectors of the preferred embodiment represent one type of passive waveguide which may be used to couple a source to a detector. In other embodiments, different waveguides may be used, such as a fiber optic strand disposed within the peripheral-based portion and having a first end proximate to a source and a second end proximate to a detector. Furthermore, other than passive forms of couplers may be used, such as optical or electrical relays possibly incorporating an intermediate detector-source pair.

Also, while the preferred embodiment addresses coding for three classes of peripheral devices, coding could be expanded to accommodate a wider range of interlock conditions. For example, in other embodiments, the number of sources and detectors may be varied and there may be more or less sources than detectors. In such a case, a source may be associated with a plurality of detectors, and vice versa. Other embodiments may employ light sources capable of transmitting light of different colors (i.e., light frequencies), wherein corresponding detectors are also capable of distinguishing among such different light transmissions. Or, sources could transmit and detectors could distinguish signals of different characteristics, such as frequency or magnitude, thereby increasing the possible code combinations of the interlock.

BRIEF DESCRIPTION OF THE DRAWINGS

The foregoing and other objects of this invention, the various features thereof, as well as the invention itself, may be more fully understood from the following description, when read together with the accompanying drawings in which.

DETAILED DESCRIPTION OF THE PREFERRED EMBODIMENTS

The present invention is an X-ray source interlock kit comprised of an X-ray source and an interlock assembly. A probe-based portion of the interlock assembly is integral with the X-ray source and produces and transmits signals to a peripheral-based portion of the interlock assembly affixed to a peripheral device. The probe-based portion and peripheral-based portion are adapted for mated engagement to form an interlock between the X-ray source and a peripheral device. When engaged, the peripheral-based portion receives those signals transmitted by the probe-based portion and, in response, transmits a corresponding signal back to the probe-based portion. The X-ray source receives such signals and in response thereto controls the output radiation of the X-ray probe. The interlock assembly is coded so that the signal transmitted back to the probe-based portion of the interlock is indicative of the class of the peripheral device. Based on the coding of the interlock assembly, the X-ray source when coupled to a peripheral device is capable of radiating, assuming other necessary conditions are met, or is prevented from radiating. While the ability for the X-ray source to radiate is discussed herein with respect to the interlock assembly, it should be noted that the X-ray source receives other inputs which also help determine whether or not the X-ray source radiates, e.g., normal automated pre-operation system checks. As will be apparent when referring to the figures, when the same element is used unchanged in more than one figure, the element retains its previously assigned identifying numeral in subsequent figures.

Figure 3A:
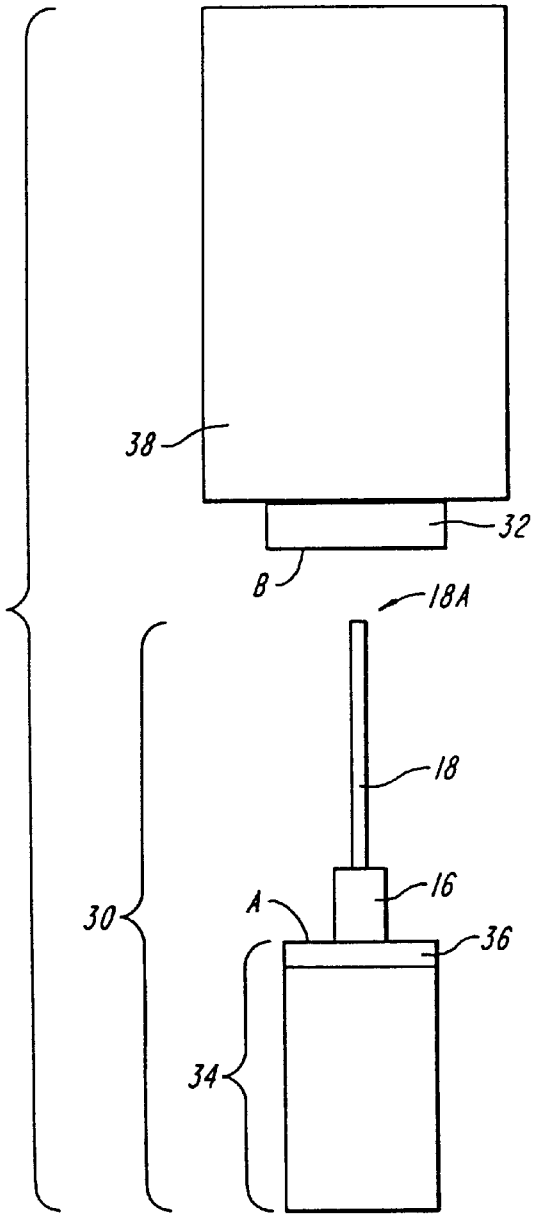
FIG. 3A is a diagrammatic top-view of an X-ray treatment system and peripheral device incorporating an X-ray source interlock kit, in accordance with the present invention.
Figure 3B:
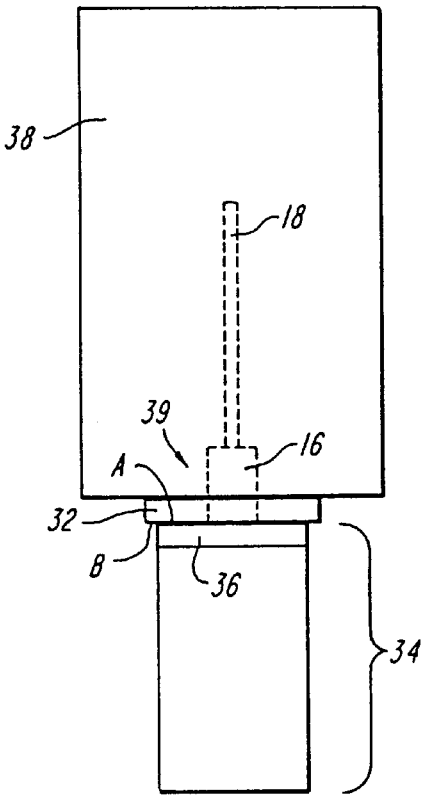
FIG. 3B is a diagrammatic top-view of the X-ray treatment system and peripheral device incorporating the X-ray source interlock kit of FIG. 3A in assembled form.

FIGS. 3A–3B show an X-ray source 30 and a peripheral device 38 incorporating the preferred embodiment of an X-ray source interlock kit in accordance with the present invention. FIG. 3A shows a top view of the X-ray source 30 of an X-ray treatment system, which includes an electron beam (e-beam) source 34, probe shoulder 16, and probe 18, including a target at its distal end 18A which is responsive to an electron beam from e-beam source 34 to generate X-rays. As with the prior art, probe shoulder 16 secures probe 18 to e-beam source 34. In the preferred form of the interlock assembly, the probe-based portion includes probe side bushing 36 and interlock electronics (not shown) and the peripheral-based portion comprises a peripheral side bushing 32. In this form, the probe side bushing and interlock electronics are integral with e-beam source 34, and the interlock electronics may be housed within e-beam source 34 or placed external to the e-beam source, e.g., within a control console operatively connected to the e-beam source 34, or in some combination thereof. The peripheral side bushing is affixed to a peripheral device probe insertion interface 39, intended to accommodate insertion of a probe into device 38. In this form, the probe side bushing and peripheral side bushing are adapted for mated engagement to form an interlock between the X-ray source and a peripheral device. The probe side bushing 36 includes a facing surface "A" and the peripheral side bushing 32 includes a facing surface "B", wherein when the probe side bushing and the peripheral side bushing are engaged (i.e., probe 18 inserted into peripheral device 38), facing surfaces A and B stay substantially in contact, as is shown in FIG. 3B. Probe 18 and probe shoulder 16 are substantially the same as those of the prior art, so will not be discussed in detail herein.

Figure 4A:
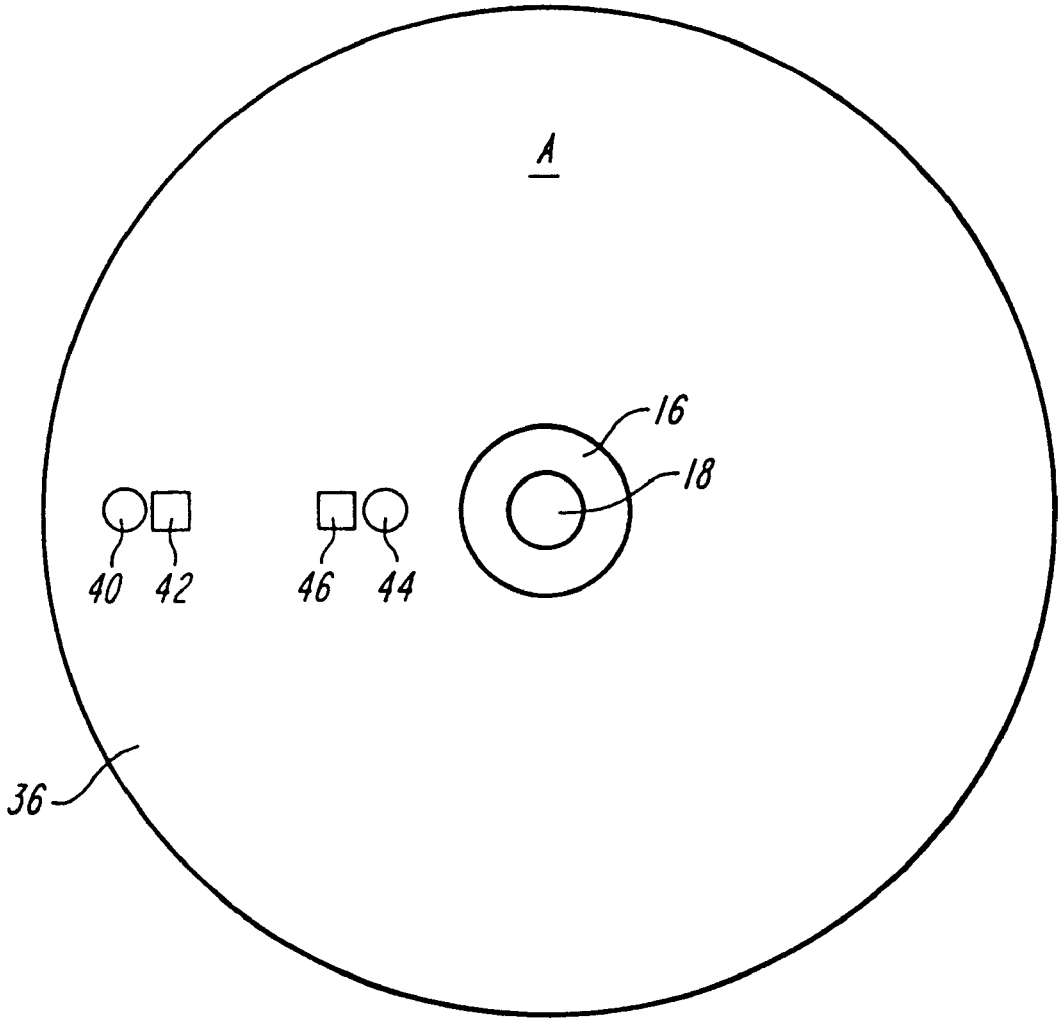
FIG. 4 is a diagrammatic view of a facing surface of the probe-based portion of the interlock kit of FIGS. 3A–B.
FIG. 4B is a diagrammatic view of the X-ray source incorporating the probe side bushing and signal generation electronics of the interlock kit of FIGS. 3A–B.

FIG. 4A shows the X-ray source 30 from a front view. In the preferred embodiment, the probe side bushing 36 is integral with the cylindrical e-beam source 34 and includes two optical sources in the facing surface A, in the form of LEDs ("light emitting diodes"), referred to as LED1 40 and LED2 44. Additionally facing surface A of probe side bushing 36 of this embodiment includes two detectors, or in this case two optical detectors 42, 46. Each of detectors 42 and 46 is associated with one of LEDs 40 and 44. Each LED and associated detector are in close proximity to each other and disposed radially outward from the center of e-beam source 34, cylindrical probe 18, and probe shoulder 16, which share a common central axis. As will be discussed in more detail, this preferred orientation of the LED and detector pairs greatly simplifies an optical path provided by peripheral-based portion of the interlock assembly of the X-ray source interlock kit.

Figure 4B:
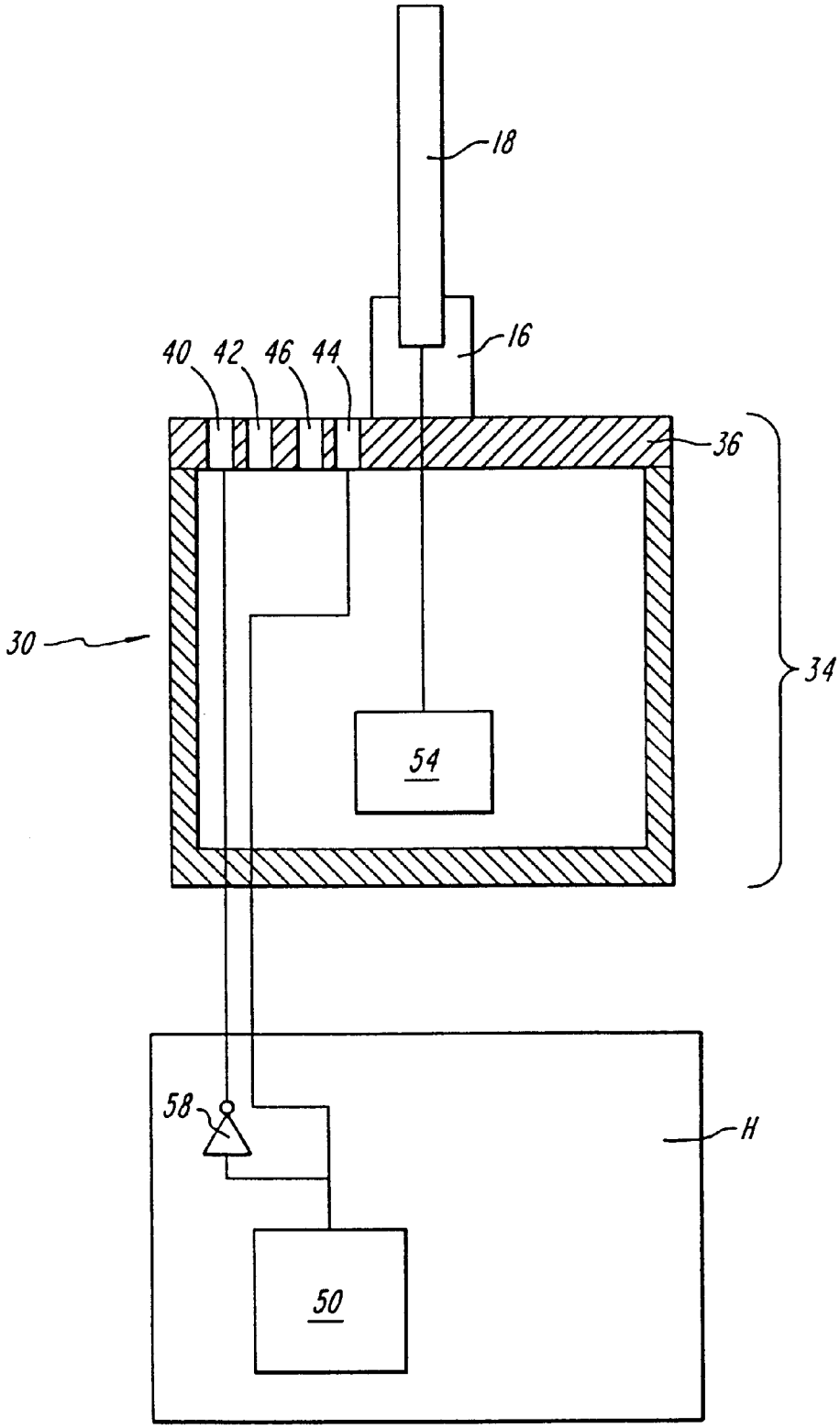

FIG. 4B shows an X-ray source 30 incorporating the probe side bushing 36 and an electron beam generator 54 within e-beam source 34 and shows a control console H which houses the signal generating electronics of the interlock assembly. The signal generating electronics include signal generator 50 and inverter 58, within console H. Two optical sources, LED1 40 and LED2 44, are included in bushing 36 and are each controlled by and connected to signal generator 50. In the illustrative embodiment, signal generator 50 produces a pulse train which alternatively turns LED1 40 and LED2 44 on and off. One approach to economically affecting the toggling of the LEDs is to place inverter 58 in the electrical path of one of the LEDs, as is shown with respect to LED2 44. In the preferred embodiment, the frequency of the pulse train is about 1000 Hz, which is chosen to be appreciably different from the frequencies of other light sources typically present with the X-ray source 30, e.g., fluorescent lighting and computer monitors. As will be apparent by those skilled in the art, such a choice in frequency simplifies the signal detector process of the interlock kit.

In the preferred embodiment, peripheral side bushing 32 is coded to provide an optical path for either one, both or none of the optical sources 40, 44 and the associated detector(s) 42 and/or 46, depending on the class of the peripheral device for which the peripheral side bushing is coded. Peripheral devices are classified based on their shielding characteristics and whether or not radiation is permitted with the device and include, for example, a stereotactic frame, a probe adjuster, and an X-ray sensitive photodiode array. Preferably, LED1 40 and LED2 44 are continuously toggled on and off, so it is the coding of a present peripheral side bushing which determines whether an optical path is established between each optical source and its associated detector. Therefore, consistent with the use of optical signal sources and detectors in X-ray source 30, the interlock assembly 60 is an optical interlock. The peripheral side bushing of the optical interlock responds to the receipt of a light signal by the LEDs 40 and 44 of the probe side bushing by communicating a substantially identical optical signal to detectors 42 and 46 of the probe side bushing, respectively. In the preferred embodiment, peripheral side bushing 32 is a reflector made of highly reflective, polished metal. Coding of the peripheral side bushing takes the form of reflective grooves in the facing surface B, in the preferred form.

Figure 5A:
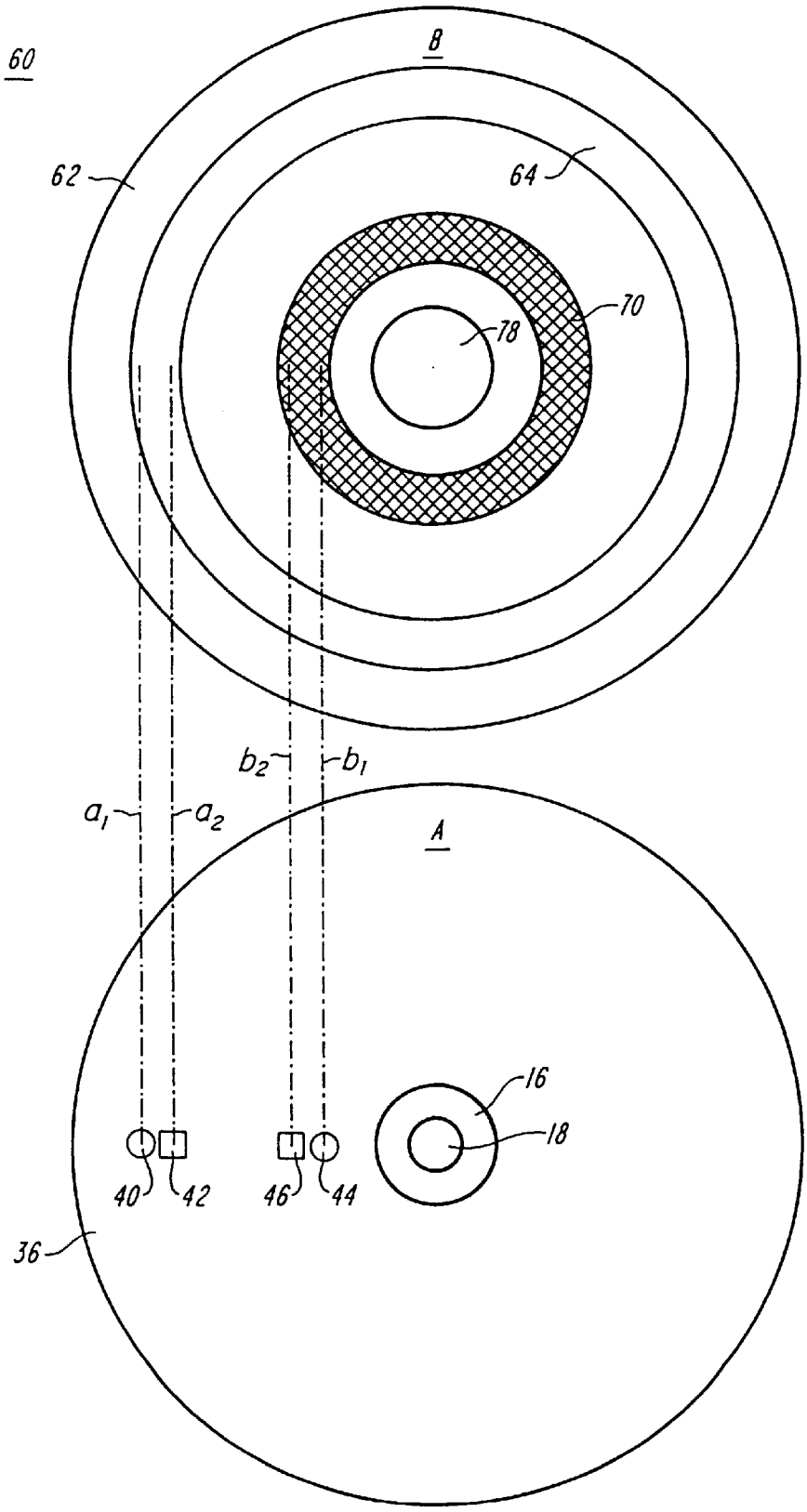
FIG. 5A is a diagrammatic view of an X-ray source interlock kit, in accordance with the present invention.

FIG. 5A shows the X-ray source interlock kit 60 of the present invention (interlock electronics not shown). The facing surface A of the probe side bushing 36 is substantially the same as that of FIG. 4A. Depending on the class of peripheral device with which the bushing is to be used, peripheral side bushing will include one circular groove, two circular grooves or no grooves at all, formed in facing surface B, in the preferred embodiment. For illustrative purposes, a peripheral side bushing 62 is shown with two grooves 64, 70 in facing surface B. Outer circular groove 64 serves as a reflective interlock for LED1 40 and detector 42, as indicated by dashed lines "a1" and "a2". And, inner circular groove 70 serves as a reflective interlock for LED2

44 and detector 46, as indicated by dashed lines "b1" and "b2". The grooves 64, 70 are circular in form so that, regardless of the orientation of facing surface A of probe side bushing 36 against facing surface B of peripheral side bushing 62, the appropriate reflector will always be aligned with its corresponding LED and detector pair, because the LED and detector pairs are each coincident with a different length radius extending from the center of the probe 18, and therefore, the center of each bushing 36 and 62. In an alternate form, instead of full circular grooves, partial circular grooves (i.e., arcuate grooves) may be used, preferably with keying elements for orienting the arcuate grooves such that they align with the appropriate light source-detector pairs.

Figure 1:
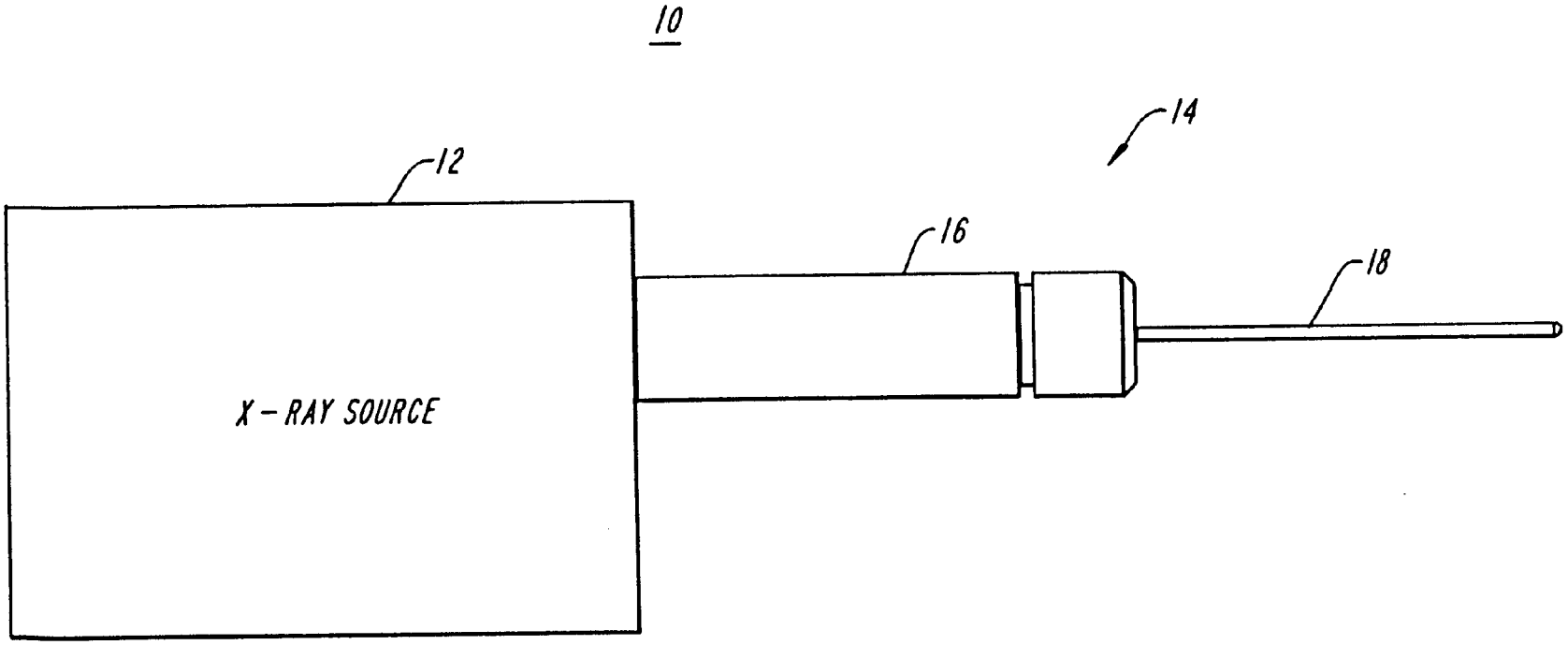
FIG. 1 (PRIOR ART)
FIG. 1 is a diagrammatic view of an X-ray treatment system of the prior art.
Figure 2:
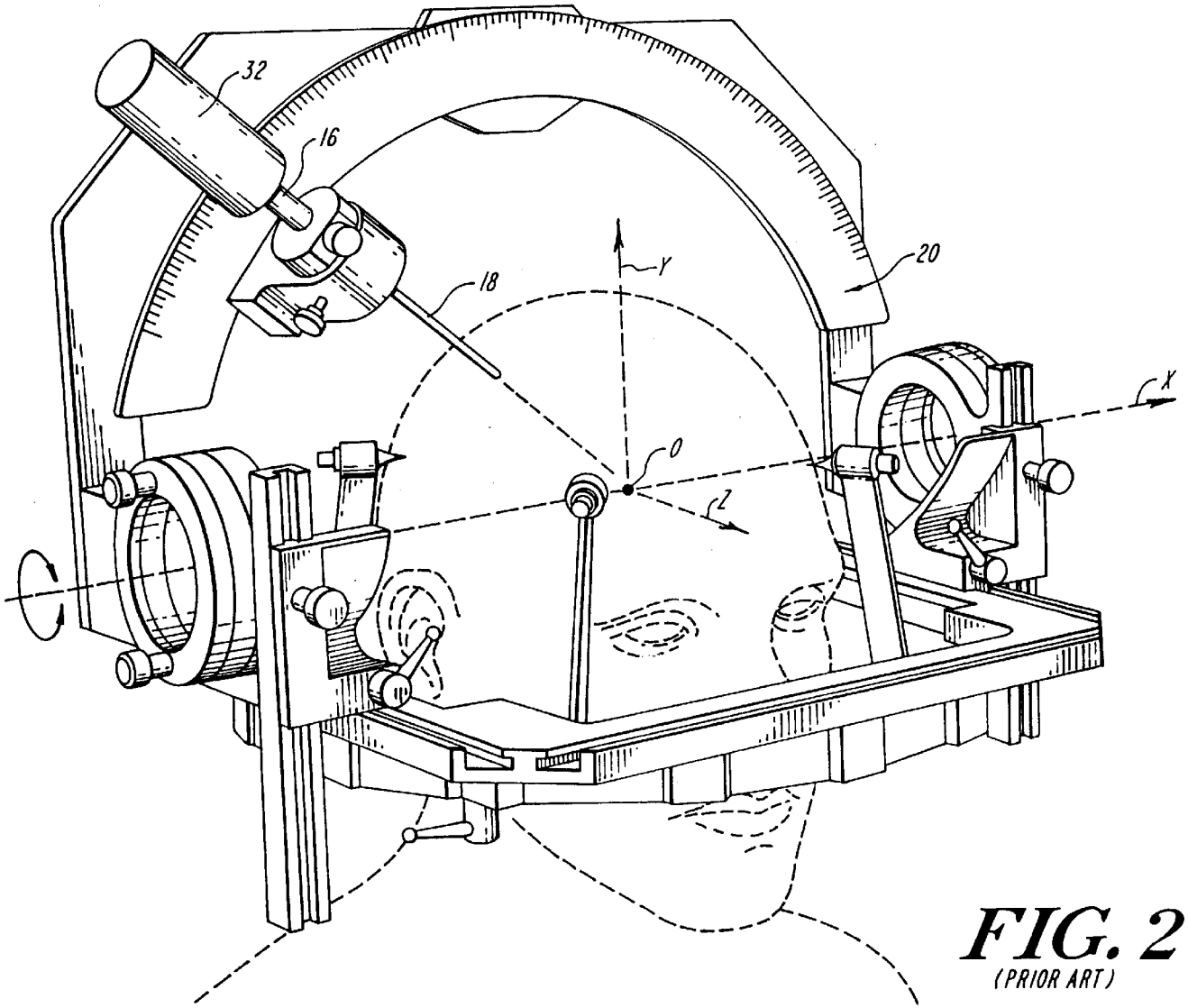
FIG. 2 (PRIOR ART)
FIG. 2 is a diagrammatic view of a stereotactic frame peripheral device of the prior art.

Peripheral side bushing 62 of FIG. 5A is "coded", with grooves 64 and 70, for use with a given class of peripheral devices, wherein the probe 18 is unshielded and radiation is permitted. As is shown, grooves 64 and 70 allow an optical path to be established between each LED and detector pair. In this embodiment, this is referred to as the "treatment configuration", because these are the conditions of a typical treatment situation. However, it should be understood that coding of the peripheral side bushing could take a variety of forms and that the specific coding which corresponds to the treatment configuration may be embodied in a variety of these alternative forms. The class of peripheral devices associated with the treatment configuration includes, for example, the stereotactic frame of FIG. 2.

Figure 5B:
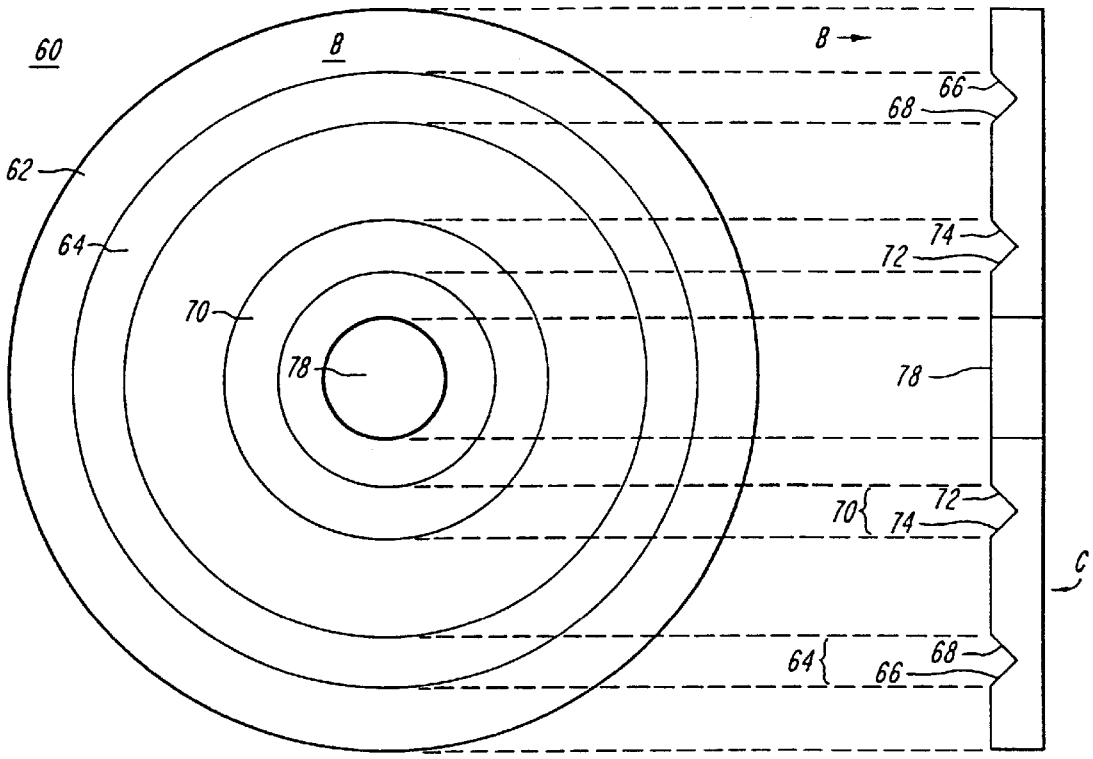
FIG. 5B is a diagrammatic front and side-view of the peripheral device side bushing of FIG. 5A.

FIG. 5B, shows a front view of facing surface B and a cut away side-view of bushing 62. The broken lines are provided to facilitate understanding of the relationship of the two views. The peripheral side bushing 62 is substantially in the form of an annular ring having a circular probe opening 78 defined about its center. The diameter of the probe opening is larger than that of the diameter of the probe 18, and preferably large enough to allow probe shoulder 16 and a probe encased in a probe sheath to be easily inserted through opening 78. The annular ring has a substantially smooth surface C which secures to the peripheral device and the coded facing surface B which is matingly engaged to the facing surface A of probe side bushing 36, to form the interlock. In another embodiment, the peripheral side bushing may be integral with or formed within the peripheral device at the probe insertion interface thereof. Thus, the probe 18 of X-ray source 30 is slidably inserted through the opening 78 of the peripheral side bushing 62 from facing surface B, such that probe 18 extends through opening 78 and facing surface A comes to rest substantially in contact with facing surface B. The form of grooves 64 and 70, of the preferred form, can be appreciated from the cut away side view of FIG. 5B, and more particularly with respect to FIG. 5C.

Figure 5C:
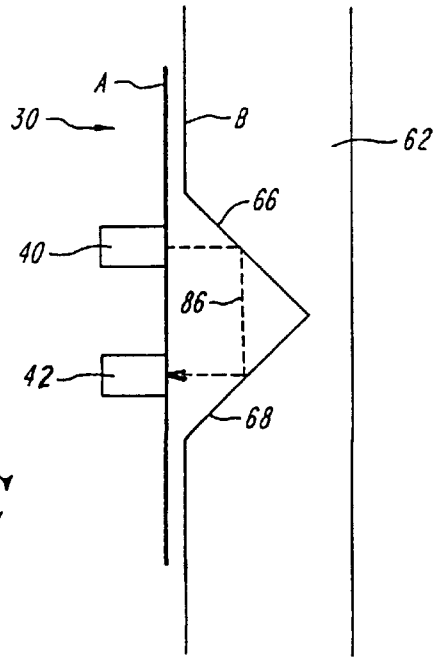
FIG. 5C is a diagrammatic partial side-view of the bushings of FIG. 4A in an assembled form.

FIG. 5C depicts how the grooves of facing surface B of peripheral side bushing 62 act as optical reflectors. This figure shows a partial cut-away side-view of facing surface A of the probe side bushing of X-ray source 30 in substantial contact with the outer groove 64 of facing surface B of peripheral side bushing 62. Outer groove 64 is shown for illustrative purposes. Inner groove 70 is comprised of surfaces 72 and 74 and is substantially the same as outer groove 64, but of a smaller radius. Outer groove 64 includes two surfaces 66 and 68 at a fixed angle to each other. In the preferred embodiment, these surfaces are at a 90 degree angle to each other. It is essential that the angle be chosen such that light originating at LED1 40 is reflected from surface 66 to surface 68 and from surface 68 to light detector 42, as depicted by arrow 86. In this way, an optical path between LED 40 and detector 42 is established. Other geometries may also be used to reflect the light from LED1 40 to detector 42.

Figure 6:
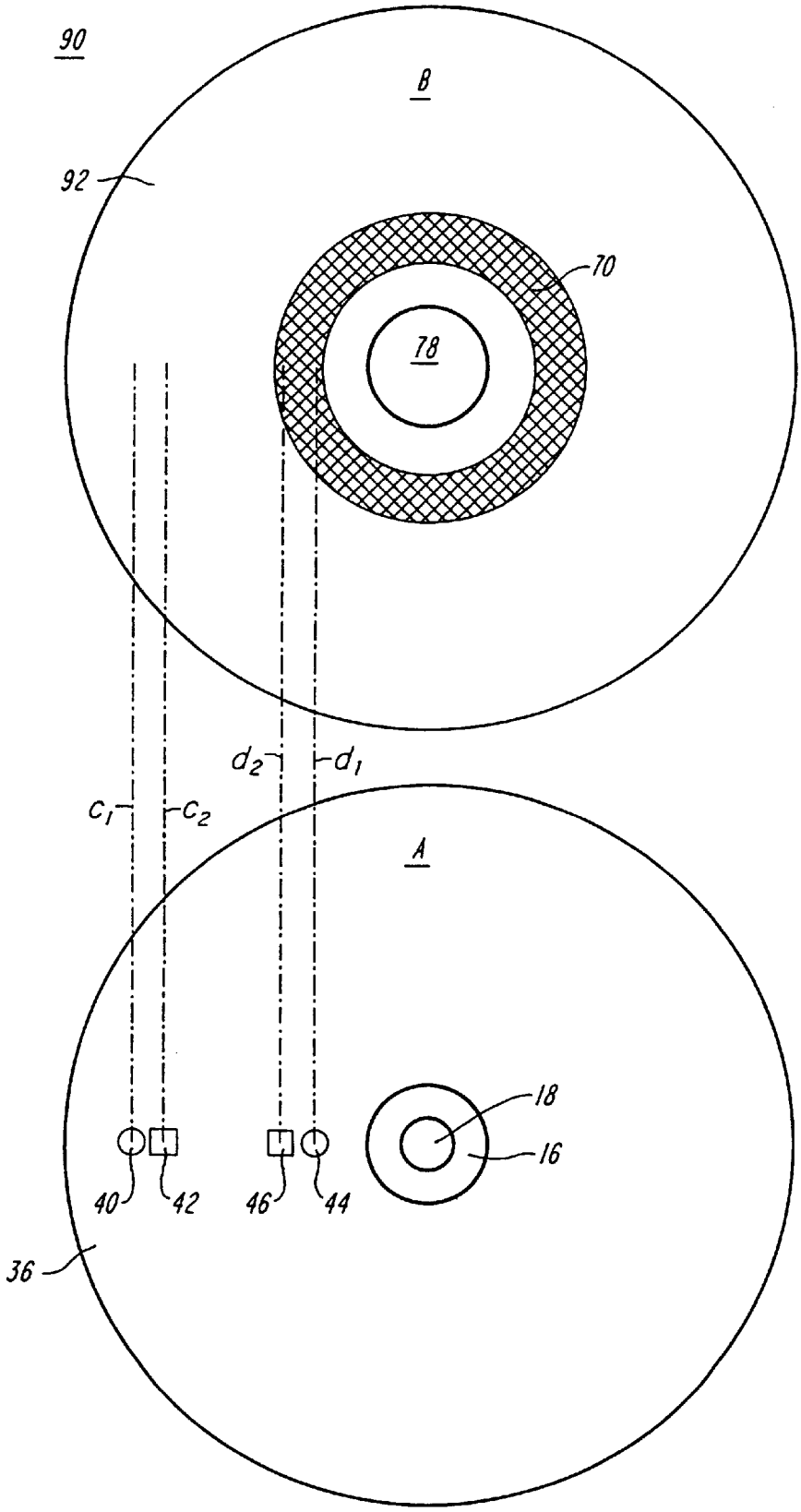
FIG. 6 is a diagrammatic view of an X-ray source interlock kit having an inner optical path, in accordance with the present invention.

FIG. 6 shows an interlock kit 90 having a peripheral side bushing 92 with a single groove formed in facing surface B and a probe side bushing 36. Bushing 92 is coded with only inner groove 70 in facing surface B. As defined, this facing surface configuration corresponds to a class of peripheral devices for which only an optical path established between LED2 44 and detector 46 is permitted. This is defined as the situation where the probe is fully shielded and radiation is permitted. The absence of outer groove 64 ensures that an optical path can never be achieved between LED 1 40 and detector 42. Broken lines "c1", "c2", "d1", and "d2" illustrate the alignment of LEDs, reflectors, and detectors according to this embodiment. Peripheral devices of the class accommodated by this embodiment include a "water tank" and a "photodiode array", both of which are used to calibrate an X-ray treatment system. Based on the fact that the body is made of a very high percentage of water, a water tank is a radiation dosimetry system for measuring and analyzing the field of ionizing radiation as generated by an X-ray source in water, as an indication of how the X-ray source will perform in the body. And, a photodiode array is a cube, within which a probe is inserted, having a photodiode placed directly in front of and along the same axis (z-axis) as the X-ray source probe and having a separate photodiode placed equidistant from the probe in the +x, −x, +y and −y directions (each attached to a separate cube face), such that the 5 photodiodes are used to determine the optimum x deflection, y deflection and isotropy settings of the X-ray source prior to treatment.

Figure 7:
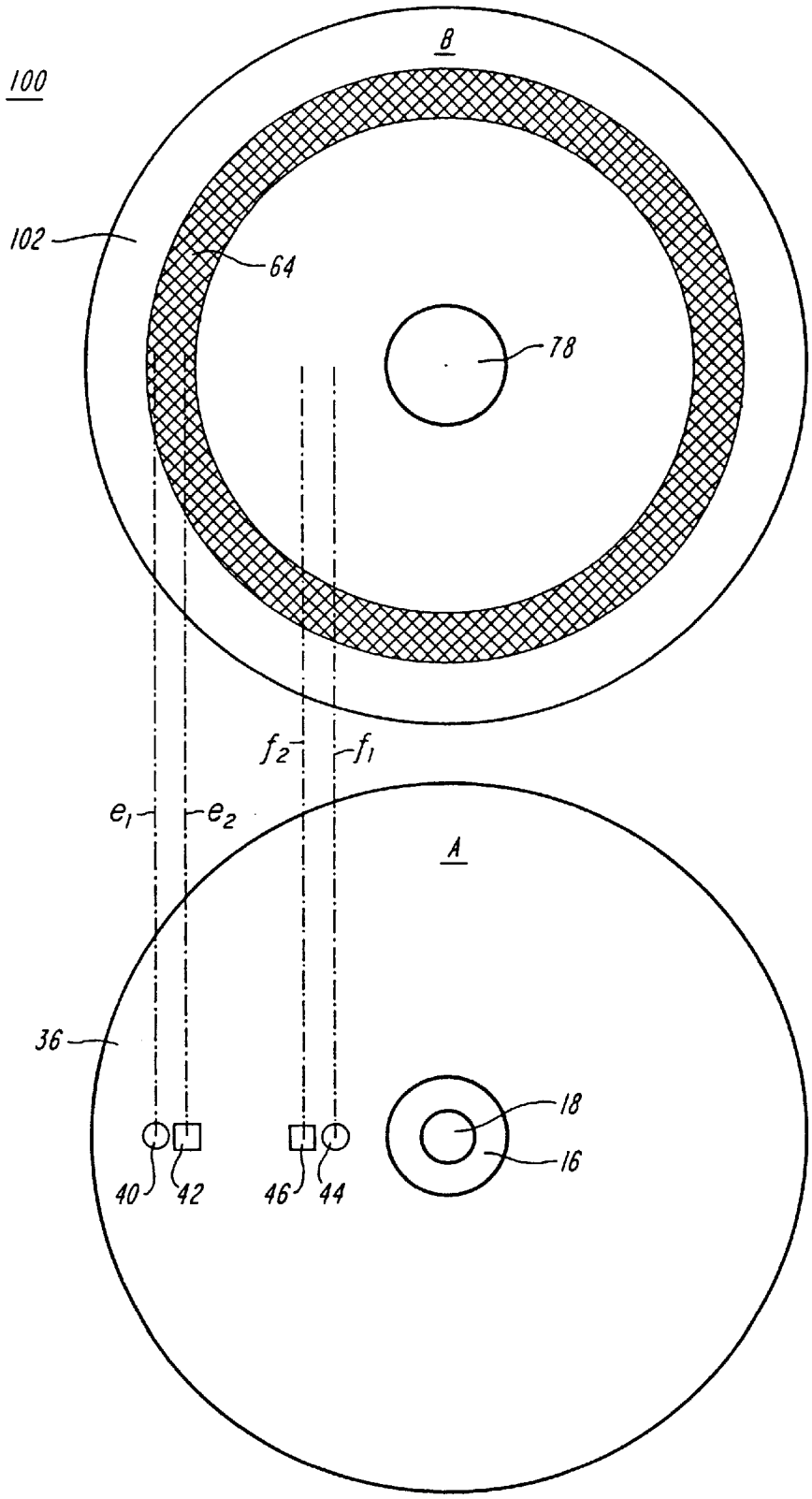
FIG. 7 is a diagrammatic view of an X-ray source interlock kit having an outer optical path, in accordance with the present invention.

FIG. 7 shows an interlock kit 100 having a peripheral side bushing 102 with a single groove formed in facing surface B and a probe side bushing 36. Bushing 102 is coded with only outer groove 64. As defined, this facing surface configuration corresponds to a class of peripheral devices for which only an optical path established between LED1 40 and detector 42 is permitted. This is defined as the situation where the probe is unshielded and radiation is not permitted. The absence of inner groove 70 ensures that an optical path can never be achieved between LED2 44 and detector 46. Broken lines "e1", "e2", "f1", and "f2" illustrate the alignment of LEDs, reflectors, and detectors according to this embodiment. Peripheral devices of the class accommodated by this embodiment include a "probe adjuster", used to physically straighten the probe. Because it is essential that the probe be straight in order to maintain an isotropic radiation output, a probe adjuster is used to measure the straightness of a probe along its central axis using an optical interference scheme and then to mechanically straighten the probe by depressing a plunger against the probe as it is rotated about the central axis.

Figure 8:
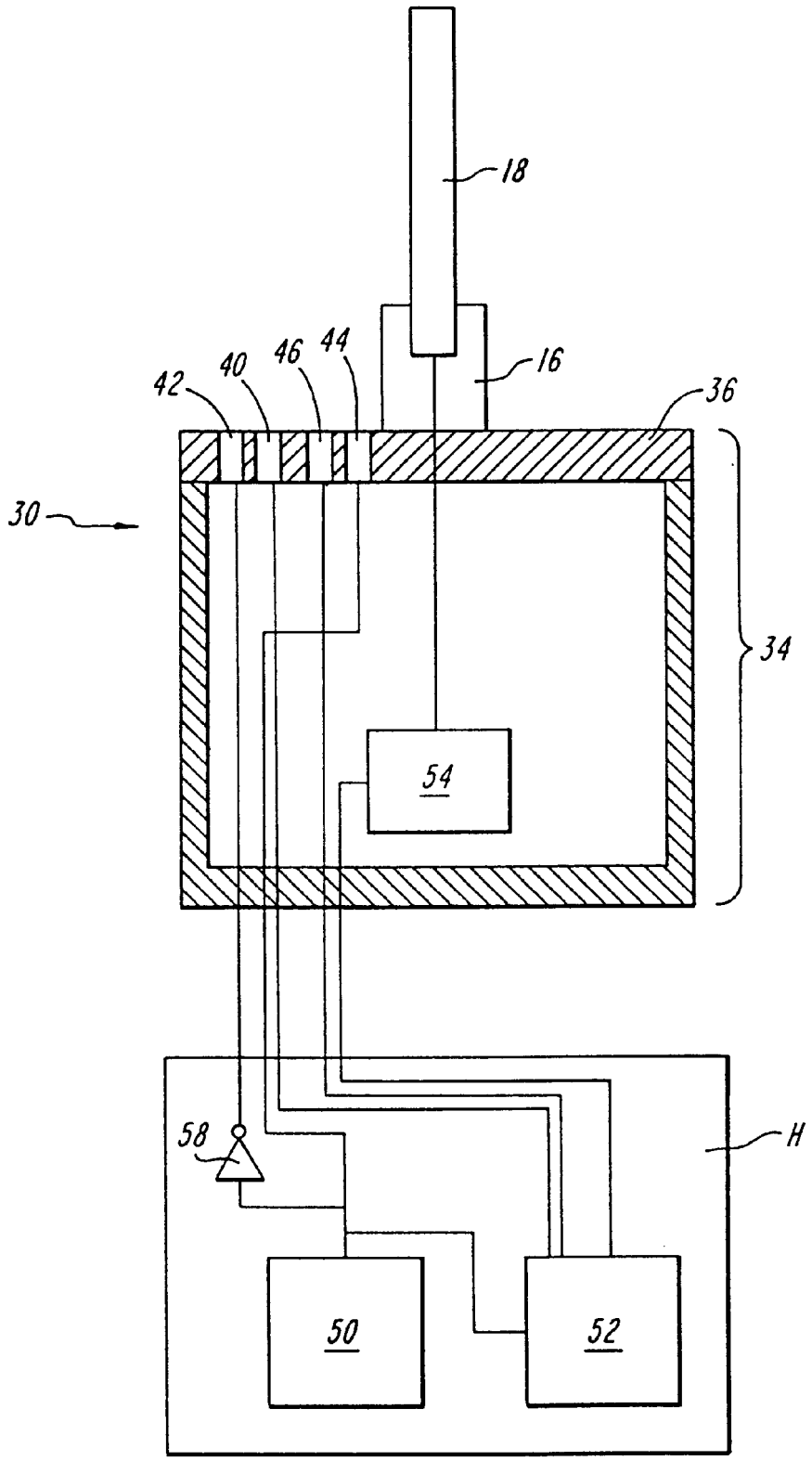
FIG. 8 is a diagrammatic view of an X-ray source incorporating the probe side bushing of FIG. 5A.

FIG. 8 shows an X-ray source 30 incorporating the probe side bushing 36, including LED1 40, LED2 44, and optical detectors 42 and 46 housed therein, in operative connection with control console H, which houses the signal detection electronics of the interlock assembly kit of the preferred embodiment of the present invention. As previously mentioned, it is preferred that signal generator 50 continually toggle LED1 40 and LED2 44 on and off at a specified frequency, appreciably different than the frequency of other typically present light sources. Therefore, the optical detectors 42 and 46 are much less likely to inadvertently detect light from a source other than X-ray source 30 and consider optical paths established for one or both optical source-detector pairs. Such erroneous signal detection could potentially increase the likelihood that the X-ray source 30 be placed in an undesirable and hazardous radiating state. Radiation controller 52 is electrically connected to each of the optical detectors 42 and 46, electron beam generator 54, and the optical signal generator 50. The radiation controller takes inputs from the detectors 42, 46 and the optical signal generator 50. When light is received by an optical detector 42 or 46, that detector transmits a corresponding signal to the radiation controller 52. The radiation controller 52 compares the signal received by the detector with the signal output and by the optical signal generator 50. If the signals substantially match in terms of magnitude, shape and frequency, the optical path is established for that LED and detector pair. As described earlier, the coding of the peripheral side bushing determines which optical paths may be established. Based on the number of optical paths established, corresponding conditions, among several system conditions, which cause the radiation controller to enable electron beam generator 54 are either satisfied or not satisfied.

Figure 9:
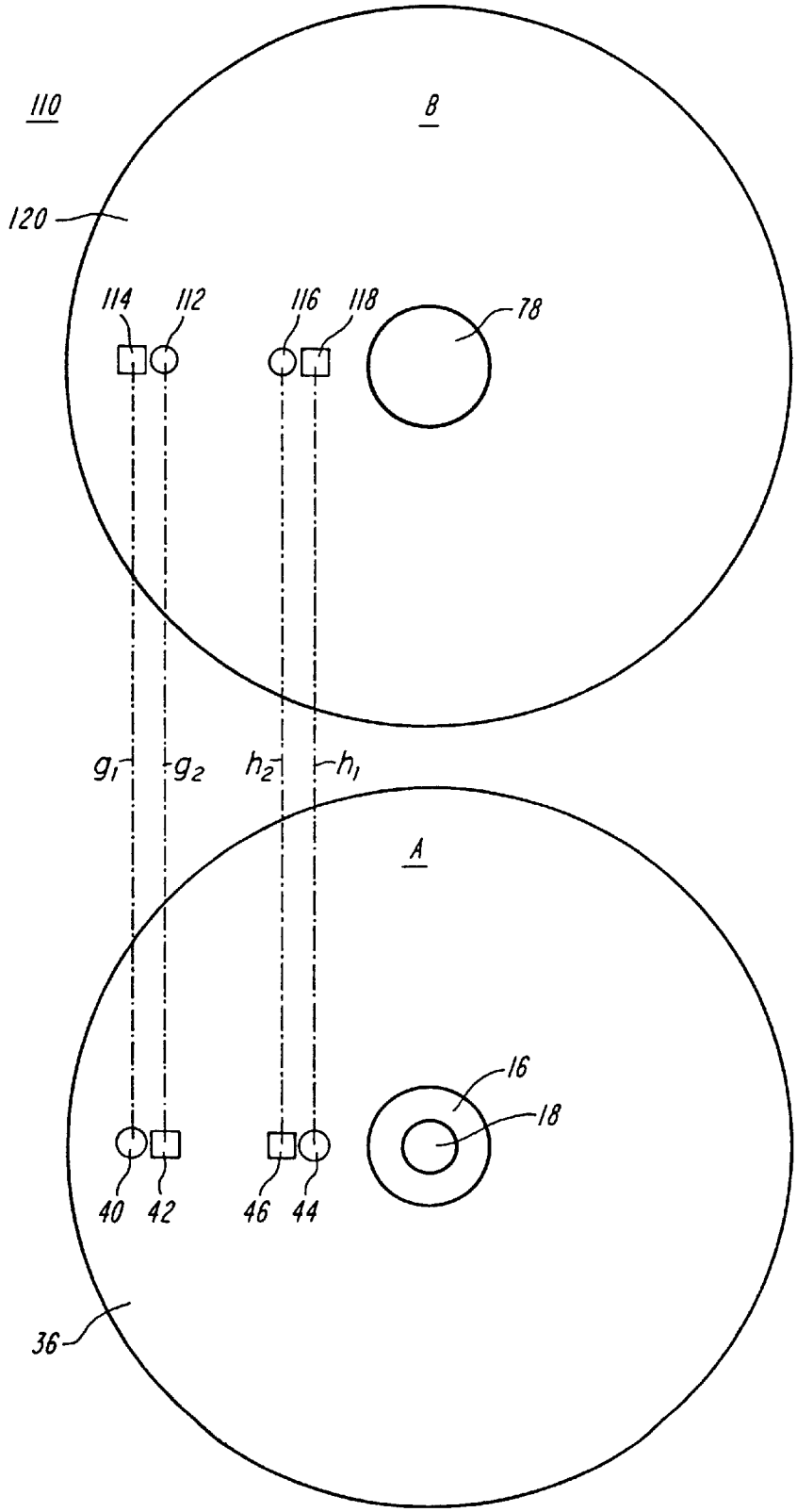
FIG. 9 is a diagrammatic probe side-view of a bushing, incorporating optical relays, and a front-view of the X-ray source of FIGS. 3A and 3B, in accordance with the present invention.

Referring to FIG. 9, another embodiment of an optical interlock kit is shown. The kit 110 includes the probe side bushing 36 and interlock electronics (not shown) integral with e-beam source 34, of the previous embodiments. However, in this embodiment, rather than using reflective grooves, a peripheral side bushing 120 has imbedded therein optical relays. As can be seen by dashed lines "g1", "g2", "h1", and "h2" the LEDs 40 and 44 from probe side bushing 36 align with the detectors 114, 118, respectively, of peripheral side bushing 120. Additionally, the detectors 42, 46 of probe side bushing 36 align with the LEDs 112 and 116, respectively, of peripheral side bushing 120. As an example of how the optical relays of this embodiment operate, when LED 44 transmits an optical signal, it is detected by detector 118. Detector 118 communicates a corresponding signal to LED 116. In response, LED 116 communicates substantially the same optical signal to detector 46. Detector 46 transmits a corresponding signal to radiation controller 52, of FIG. 8. In this way, the optical message transmitted by LED 44 is received by detector 46, thus an optical path is established. This same method of communication is used with respect to LED 40 and detector 42. Given that optical relays are used in the embodiment of bushing 120, it is not necessary that the bushing include highly reflective material. However, deliberate alignment of LEDs and detectors is required between bushing 36 and bushing 120.

The invention may be embodied in other specific forms without departing from the spirit or central characteristics thereof. For example, electrical or mechanical relays, or some combination of relays and waveguides, could also be used in various interlock embodiments. While the preferred form is described with respect to reflective grooves, other types of passive waveguides may also be used to couple sources to detectors, such as fiber optic strands within a peripheral-based portion. Additionally, while the invention is described as having an equal amount of sources and detectors, forming source detector pairs, the number of sources may differ from the number of detectors. For example, the probe side bushing could include a radial alignment, from the probe center, of source1-detector1-detector2-detector3-source2, wherein a reflective groove, for example, may be "coded" to span source1-detector1-detector2. In other embodiments, optical sources which transmit light of different colors (i.e., different frequencies) may be used with detectors capable of discerning such color differences. The present embodiments are therefore to be considered in all respects as illustrative and not restrictive, the scope of the invention being indicated by appending claims rather than by the foregoing description, and all changes that come within the meaning and range of equivalency of the claims are therefore intended to be embraced therein.

What is claimed is:

1. An X-ray source interlock kit, for use as an interface between an X-ray source and a peripheral device, wherein the X-ray source includes an electron beam source for selectively generating and directing an electron beam along a central axis and an X-ray probe extending from said electron beam source along said central axis and including a target at a distal tip thereof responsive to said electron beam to generate X-rays, the X-ray source interlock kit comprising:

A. a probe based portion affixed to the X-ray source including:
   i. a transmitter;
   ii. a receiver;
   iii. an interlock controller in operative communication with the transmitter, receiver, and the electron beam source; and B. a peripheral based portion affixed to a peripheral device, and adapted for mating engagement with said probe based portion, defining a coded signal path correlated with at least one characteristic of said peripheral device, whereby when said peripheral based portion is engaged to the probe based portion, the transmitter is selectively coupled to the receiver.

2. The X-ray source interlock kit of claim 1 wherein the probe based portion is integral with the electron beam source.

3. The X-ray source interlock kit of claim 1 wherein the interlock controller comprises:

i. a signal generator in operative communication with the transmitter; and ii. a radiation controller in operative communication with the electron beam source and receiver, wherein reception by the receiver of a signal corresponding to a signal transmitted by the transmitter satisfies a condition necessary for the radiation controller to enable the electron beam source in response to said reception by the receiver.

4. The X-ray source interlock kit of claim 1 wherein the probe based portion includes a probe bushing which houses the transmitter and the receiver.

5. The X-ray source interlock kit of claim 1 wherein the transmitter is a light source.

6. The X-ray source interlock of claim 5 wherein the light source is a light emitting diode.

7. The X-ray source interlock kit of claim 5 wherein the receiver is an optical detector.

8. The X-ray source interlock kit of claim 7 wherein the peripheral based portion includes a peripheral bushing which includes an optical coupler for coupling the light source with the optical detector, when the probe based portion and peripheral based portion are engaged.

9. The X-ray source interlock kit of claim 8 wherein the optical coupler is comprised of an optical relay.

10. The X-ray source interlock kit of claim 8 wherein the optical coupler is comprised of waveguide.

11. The X-ray source interlock kit of claim 10 wherein the waveguide is an optical reflector.

12. The X-ray source interlock kit of claim 11 wherein the optical reflector is formed out of highly polished metal.

13. The X-ray source interlock kit of claim 11 wherein the optical reflector is a reflective groove formed in the peripheral bushing.

14. The X-ray source interlock kit of claim 13 wherein the groove includes a first side and a second side disposed at an angle of 90 degrees to each other and, when engaged with the probe based portion, are disposed at an angle of about 45 degrees to a plane extending from the surface of the probe side portion and halfway between the light source and optical detector and at a 90 degree angle to a line which includes the light source and optical detector.

15. The X-ray source interlock kit of claim 14 wherein:

i. the groove is an arcuate groove formed about the center of the peripheral bushing, and about the central axis when the probe based portion and peripheral based portion are engaged; and ii. the light source and the optical detector are disposed along a radius extending from the central axis.

16. The X-ray source interlock kit of claim 15 wherein the arcuate groove is a circular groove which extends a full 360 degrees about the central axis of the X-ray source, when the probe based portion and peripheral based portion are engaged.

17. The X-ray source interlock kit of claim 1 wherein the peripheral based portion is coded for use with a given class of peripheral device, each class embodying at least one of said peripheral device characteristics.

18. The X-ray source interlock kit of claim 17 wherein the peripheral based portion is coded to enable the X-ray source to radiate for a class of peripheral device characterized by permitting unshielded radiation.

19. The X-ray source interlock kit of claim 17 wherein the peripheral based portion is coded to enable the X-ray source to radiate for a class of peripheral device characterized by permitting shielded radiation.

20. The X-ray source interlock kit of claim 17 wherein the peripheral based portion is coded to disable the X-ray source from radiating for a class of peripheral device characterized by not permitting unshielded radiation.

21. The X-ray source interlock kit of claim 1, wherein the probe based portion and peripheral based portion include a keying element which ensures alignment of the coded signal path of the peripheral based portion with the transmitter and receiver of the probe based portion when engaged.

22. An X-ray source interlock kit, for use as an interface between an X-ray source and a peripheral device, wherein the X-ray source includes an electron beam source for selectively generating and directing an electron beam along a central axis and an X-ray probe extending from said electron beam source along said central axis and including a target at a distal tip thereof responsive to said electron beam to generate X-rays, the X-ray source interlock kit comprising:

A. a probe based portion affixed to the X-ray source including:

i. a first and a second light source;

ii. a first and a second optical detector;

iii. an interlock controller in operative communication with the first and second light sources, the first and second optical detectors, and the electron beam source; and B. a peripheral based portion affixed to a peripheral device, and adapted for mating engagement with said probe based portion, including:

i. a first reflective groove, defining a first coded optical path correlated with at least one characteristic of said peripheral device, whereby when said peripheral based portion is engaged to the probe based portion, the first light source is selectively coupled to the first optical detector.

23. The X-ray source kit of claim 22 wherein the peripheral based portion further comprises:

ii. a second optical groove, defining a second coded optical path correlated with at least one characteristic of said peripheral device, whereby when said peripheral based portion is engaged to the probe based portion, the second light source is selectively coupled to the second optical detector.

* * * * *